US008628363B2

(12) United States Patent
Kobayashi et al.

(10) Patent No.: US 8,628,363 B2
(45) Date of Patent: Jan. 14, 2014

(54) CRIMPED ELECTRIC WIRE WITH TERMINAL AND METHOD FOR PRODUCING THE SAME

(75) Inventors: Kazumasa Kobayashi, Yokkaichi (JP); Takuji Ootsuka, Yokkaichi (JP); Hiroki Shimoda, Yokkaichi (JP)

(73) Assignees: Autonetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 260 days.

(21) Appl. No.: 12/852,815

(22) Filed: Aug. 9, 2010

(65) Prior Publication Data

US 2011/0034091 A1 Feb. 10, 2011

(30) Foreign Application Priority Data

Aug. 7, 2009 (JP) ..... 2009-184426

(51) Int. Cl.
*H01R 4/18* (2006.01)

(52) U.S. Cl.
USPC ..... 439/877

(58) Field of Classification Search
USPC ..... 439/877, 882, 874; 174/84 C
See application file for complete search history.

(56) References Cited

U.S. PATENT DOCUMENTS

| | | | | |
|---|---|---|---|---|
| 2,987,697 | A * | 6/1961 | Davis | 439/849 |
| 3,955,044 | A | 5/1976 | Hoffman et al. | |
| 5,561,267 | A | 10/1996 | Fudoo et al. | |
| 7,544,892 | B2 * | 6/2009 | Susai et al. | 174/84 R |
| 8,221,171 | B2 * | 7/2012 | Ono et al. | 439/877 |
| 2005/0026515 | A1 | 2/2005 | Hashimoto et al. | |
| 2008/0230269 | A1 * | 9/2008 | Susai et al. | 174/84 C |
| 2011/0028054 | A1 * | 2/2011 | Tanaka et al. | 439/878 |

FOREIGN PATENT DOCUMENTS

| | | |
|---|---|---|
| FR | 2893193 | 5/2007 |
| JP | 63-198268 | 8/1988 |
| JP | 649361 | 1/1989 |
| JP | 5-22209 | 3/1993 |
| JP | 680263 | 11/1994 |
| JP | 7-73950 | 3/1995 |
| JP | 2005174896 | 6/2005 |
| JP | 2005327690 | 11/2005 |
| JP | 2006-012716 | 1/2006 |
| JP | 20006286385 | 10/2006 |
| JP | 2009-218072 | 9/2009 |
| WO | 2007054554 | 5/2007 |

* cited by examiner

*Primary Examiner* — Briggitte R Hammond
(74) *Attorney, Agent, or Firm* — Gerald E. Hespos; Michael J. Porco; Matthew T. Hespos

(57) ABSTRACT

A crimped electric wire with a terminal, includes: an electric wire having a core wire made of aluminum or aluminum alloy; and a terminal fitting having an electric wire crimping section for crimping the core wire partly exposed from the electric wire, wherein: a value obtained by dividing the height of the electric wire crimping section by the width of the electric wire crimping section after the crimping of the electric wire crimping section is set to 0.5 or more and 0.6 or less; and the value obtained by dividing the gross cross-sectional area of the core wire after the crimping of the electric wire crimping section by the gross cross-sectional area of the core wire before the crimping of the electric wire crimping section is set to 55% or more and 65% or less.

3 Claims, 9 Drawing Sheets

TERMINAL MATERIAL:CAC 60
SHEET THICKNESS:0.25 mm
DEVELOPED LENGTH OF BARREL:5.5 mm
TYPE OF PLATING:TIN PLATING
MATERIAL OF ELECTRIC WIRE:ALUMINUM
CRIMPING MACHINE:2-TON PRESS

CRIMPED ELECTRIC WIRE WITH TERMINAL AND METHOD FOR PRODUCING THE SAME

BACKGROUND OF THE INVENTION

1. Field of the Invention

The present invention relates to a crimped electric wire with a terminal and a method for producing the same.

2. Description of the Related Art

Generally, a terminal fitting equipped with an electric wire crimping section for crimping a core wire exposed at the end of an electric wire is known as a terminal fitting that is connected to the end of an electric wire. This electric wire crimping section has a pair of barrel pieces rising from both end fringes of the bottom plate of the terminal fitting. When the core wire is placed on the bottom plate and swaged using an anvil and a crimper in the vertical direction, the core wire is conductively connected to the electric wire crimping section.

The issue of specifically determining what kind of shape is formed as the crimped shape of the core wire using the barrel pieces of the electric wire crimping section is generally controlled depending on the value of the crimp height (the height dimension of the electric wire crimping section) in a crimping machine. Although the crimp width (the width dimension of the electric wire crimping section) is available as a parameter for determining the shape of the electric wire crimping section, the crimp width is determined, for example, by the dimensions of the cavity in a connector housing accommodating the terminal fitting and the value of the crimp width is settled to a specific value depending on the shapes of the anvil and the crimper. Hence, only the downward stroke (this determines the crimp height) of the crimper of the crimping machine toward the anvil can be adjusted at the time of the crimping.

Conventionally, in the case that a copper electric wire having a core wire made of copper or copper alloy (hereafter simply referred to as "copper") is crimped, the crimp height is generally adjusted so that the core wire is crimped at a relatively low compression ratio (at a compression ratio lower than that in the case that an aluminum electric wire is crimped as described below).

However, in recent years, for the purpose of making electric wires lighter and using alternate electric wires instead of copper electric wires, a study of using aluminum electric wires having a core wire made of aluminum or aluminum alloy (hereafter simply referred to as "aluminum") for vehicle wire harnesses is being conducted. Aluminum has properties such that the rigidity of aluminum is higher than that of copper and such that a non-conductive film is apt to be formed on the surface of aluminum. Hence, it is assumed that an aluminum electric wire should be crimped at a compression ratio higher than that when a copper electric wire is crimped. By virtue of the high compression crimping, the non-conductive film is easily broken, and the contact resistance can be prevented from increasing even when the terminal fitting is subjected to a thermal shock cycle.

However, copper alloy or brass is generally used as the base material of the terminal fitting although the aluminum electric wire is made of aluminum. Hence, when high compression crimping is performed, a problem is revealed in which the elongation of the electric wire crimping section is larger than that in the case of the copper electric wire. Accordingly, for the purpose of suppressing the elongation ratio of the electric wire crimping section due to the high compression crimping, attempts to solve this problem have been made by using methods in which the terminal fitting is made of an expensive material having a small elongation ratio and the shape of the terminal fitting is modified ingeniously, for example.

Since high compression is required in the case of crimping the aluminum electric wire as described above, the elongation ratio of the terminal fitting inevitably becomes large. On the other hand, if the compression ratio is relieved, the contact resistance increases when the terminal fitting is subjected to a thermal shock cycle, whereby the compression ratio cannot be relieved. For these reasons, it has been considered very difficult to simultaneously suppress the elongation ratio of the terminal fitting and suppress the contact resistance from increasing as long as the aluminum electric wire is crimped.

Besides, the above related arts are disclosed by JP-A-H07-73950 and JP-A-2006-12716.

SUMMARY OF THE INVENTION

In consideration of the above-mentioned circumstances, the present invention is intended to provide a crimped electric wire capable of suppressing the contact resistance between an electric wire and the electric wire crimping section of a terminal fitting even when the electric wire is subjected to a thermal shock cycle while the elongation ratio of the terminal fitting is suppressed small and to provide a method for producing the same.

Through various experiments, the inventors of the present invention have found that the elongation ratio of the terminal fitting can be suppressed, instead of controlling the values of the crimp height and the crimp width while paying attention to only the compression ratio, by controlling crimping conditions so that the compression ratio is within a specific range and furthermore so that the value (hereafter referred to as "height to width ratio") obtained by dividing the crimp height (H) by the crimp width (W) is within a certain range. In other words, the inventors have found for the first time that when the height to width ratio is smaller than the values in a predetermined range, the elongation ratio of the terminal fitting due to crimping becomes larger and that even if the height to width ratio is changed inversely so as to be larger than the values in the predetermined range, there is a height to width ratio at which the elongation ratio is large and the elongation is minimal.

According to an aspect of the invention, there is provided a crimped electric wire with a terminal, including: an electric wire having a core wire made of aluminum or aluminum alloy; and a terminal fitting having an electric wire crimping section for crimping the core wire partly exposed from the electric wire, wherein in a case that a value obtained by dividing the height of the electric wire crimping section by the width of the electric wire crimping section after the crimping of the electric wire crimping section is referred to as a height to width ratio and that the value obtained by dividing the gross cross-sectional area of the core wire after the crimping of the electric wire crimping section by the gross cross-sectional area of the core wire before the crimping of the electric wire crimping section is referred to as a compression ratio, the height to width ratio is set to 0.5 or more and 0.6 or less, and the compression ratio is set to 55% or more and 65% or less.

The height to width ratio may be set to 0.55, and the compression ratio may be set to 60%.

The crimp height is a dimension in the height direction from the lower end position of the crimped cross-section of the terminal fitting (the electric wire crimping section) to the upper end position thereof. The crimp width is a dimension in the width direction from the left end position of the crimped cross-section of the terminal fitting (the electric wire crimping section) to the right end position thereof. The height direction and the width direction extend in directions orthogonal to each other in a face orthogonal to the axial direction of the core wire.

Furthermore, the compression ratio is the value obtained by dividing the gross cross-sectional area S1 of the core wire after the crimping of the electric wire crimping section by the gross cross-sectional area S2 of the core wire before the crimping of the electric wire crimping section. The gross cross-sectional area S2 of the core wire before the crimping of the electric wire crimping section is the value obtained by the calculation of (the cross-sectional area of one element wire constituting the core wire)×(the number of element wires), and the gross cross-sectional area S1 of the core wire after the crimping of the electric wire crimping section is the measured value obtained by calculating the area of the cross-sectional shape obtained after the crimping.

Moreover, the elongation ratio of the terminal fitting is the value obtained by the calculation of (the total length of the terminal fitting after the crimping)/(the total length of the terminal fitting before the crimping), and the total length of the terminal fitting is the dimension of the terminal fitting in the axial direction of the core wire crimped using the electric wire crimping section. The total length of the terminal fitting after the crimping is the value obtained by measuring the total length of the terminal fitting after the crimping.

FIG. 6 shows a crimped cross-section obtained by setting the height to width ratio to 0.55 and by setting the compression ratio to 60%. The terminal fitting 20 shown in FIG. 6 has a bottom plate 21, a pair of barrel pieces 22 rising from both end fringes of the bottom plate 21 and a core wire 23 swaged using the bottom plate 21 and the barrel pieces 22. Furthermore, the crimp height shown in FIG. 6 is a dimension designated by H1, and the crimp width shown in FIG. 6 is a dimension designated by W1. The crimped cross-section shown in FIG. 6 has an ideal crimped shape according to the present invention, and the height to width ratio (H1/W1) is 0.55.

Next, FIG. 7 shows a crimped cross-section obtained by setting the height to width ratio to 0.78 and by setting the compression ratio to 60%. The terminal fitting 30 shown in FIG. 7 has a bottom plate 31, a pair of barrel pieces 32 rising from both end fringes of the bottom plate 31 and a core wire 33 swaged using the bottom plate 31 and the barrel pieces 32. Furthermore, the crimp height shown in FIG. 7 is a dimension designated by H2, and the crimp width shown in FIG. 7 is a dimension designated by W2.

In the case of FIG. 7, since the height to width ratio (H2/W2) is set to a value larger than those in the predetermined range (0.5 or more and 0.6 or less), even thought the compression ratio is set to a value within the predetermined range (55% or more and 65% or less), the elongation ratio of the terminal fitting 30 is larger than that of the terminal fitting 20 shown in FIG. 6. The reason for exhibiting this behavior is attributed to the following.

In the portion (the upper portion of the barrel) constituting the upper face R of the barrel piece 32, since the upper face R is small, the tip end of the barrel piece 32 is rounded. Hence, it is assumed that the thickness becomes larger by the amount of the rounding and that the rigidity of the portion becomes higher (in other words, the portion becomes hard to be elongated).

Next, in the portion (the intermediate portion of the barrel) constituting the vertical face V of the barrel piece 32, since the barrel piece 32 rises in the same direction as the direction (vertical direction) in which a load is applied. Hence, it is assumed that the thickness increases when the load is applied and that the rigidity of the portion becomes higher (in other words, the portion becomes hard to be elongated).

On the other hand, in the bottom plate 31 (the lower portion of the barrel), since the thickness decreases when a load is applied, the portion becomes easy to be elongated. Furthermore, a constant load is applied to the terminal fitting as a whole, and the rigidity at the upper portion of the barrel and the rigidity at the intermediate portion of the barrel are high, whereby the portions are hard to be elongated as described above. Hence, the load tends to concentrate on the bottom plate 31, whereby it is assumed that the bottom plate 31 becomes easy to be elongated further.

Finally, FIG. 8 shows a crimped cross-section obtained by setting the height to width ratio to 0.44 and by setting the compression ratio to 60%. The terminal fitting 40 shown in FIG. 8 has a bottom plate 41, a pair of barrel pieces 42 rising from both end fringes of the bottom plate 41 and a core wire 43 swaged using the bottom plate 41 and the barrel pieces 42. Furthermore, the crimp height shown in FIG. 8 is a dimension designated by H3, and the crimp width shown in FIG. 8 is a dimension designated by W3.

In the case of FIG. 8, since the height to width ratio is set to a value smaller than those in the predetermined range (0.5 or more and 0.6 or less), even thought the compression ratio is set to a value within the predetermined range (55% or more and 65% or less), the elongation ratio of the terminal fitting 40 is larger than that of the terminal fitting 20 shown in FIG. 6. The reason for exhibiting this behavior is attributed to the following.

In the portion (the upper portion of the barrel) constituting the upper face R of the barrel piece 42, since the upper face R is large, the barrel piece 42 is hard to be rounded. Hence, the thickness does not increase when a load is applied, whereby the rigidity is hard to be increased. However, since the tip end of the barrel piece 42 tends to be turned toward the bottom plate 41 due to the load applied to the upper portion of the barrel, the load applied to the upper face R of the barrel piece 42 easily concentrates on the bottom plate 41.

On the other hand, the barrel piece 42 shown in FIG. 8 does not rise in the same direction as the direction (vertical direction) in which the load is applied. In other words, the intermediate portion of the barrel shown in FIG. 7 falls down, thereby constituting part of the upper portion of the barrel. Hence, the intermediate portion of the barrel does not exist in FIG. 8. As a result, since the tip end of the barrel piece 42 is closer to the bottom plate 41, the load is easily applied from the tip end of the barrel piece 42 to the bottom plate 41. Hence, the bottom plate 41 is easy to be elongated.

In that respect, in the present invention, the terminal fitting 20 shown in FIG. 6 has a cross-sectional shape positioned halfway between the cross-sectional shape of the terminal fitting 30 shown in FIG. 7 and the cross-sectional shape of the terminal fitting 40 shown in FIG. 8. Hence, the load does not concentrate on the bottom plate 21 but is easy to be distributed to the bottom plate 21 and both the barrel pieces 22. In other words, the load is easily distributed to the bottom plate 21 and both the barrel pieces 22 by setting the height to width ratio (H1/W1) within the predetermined range (0.5 or more and 0.6 or less). For this reason, the elongation ratio of the terminal fitting 20 is suppressed so as to be smaller than those of the terminal fitting 30 shown in FIG. 7 and the terminal fitting 40 shown in FIG. 8. Furthermore, since the compression ratio is set within the predetermined range (55% or more and 65% or less), the contact resistance does not increase even when the terminal fitting is subjected to a thermal shock cycle.

With the present invention, the contact resistance between the electric wire and the electric wire crimping section can be suppressed from increasing even when the terminal fitting is subjected to a thermal shock cycle while the elongation of the terminal fitting is suppressed small.

BRIEF DESCRIPTION OF THE DRAWINGS

The present invention will become more fully understood from the detailed description given hereinbelow and the accompanying drawing which is given by way of illustration only, and thus is not limitative of the present invention and wherein.

DETAILED DESCRIPTION OF THE PREFERRED EMBODIMENTS

An embodiment according to the present invention will be described below referring to FIGS. 1 to 9. A crimped electric wire with a terminal according to the embodiment is configured so that a terminal fitting 10 is crimp-connected to the end of an electric wire 14. An example is described in which the terminal fitting 10 is used as a female terminal fitting. The overall structure of the terminal fitting 10 before crimping is shown in a plan view of FIG. 1. A hoop material made of a copper alloy sheet is stamped out using a press into a predetermined shape as shown in FIG. 2 and folded and bent so as to be formed into the state shown in FIG. 1, whereby the terminal fitting 10 is obtained.

Figure 1:
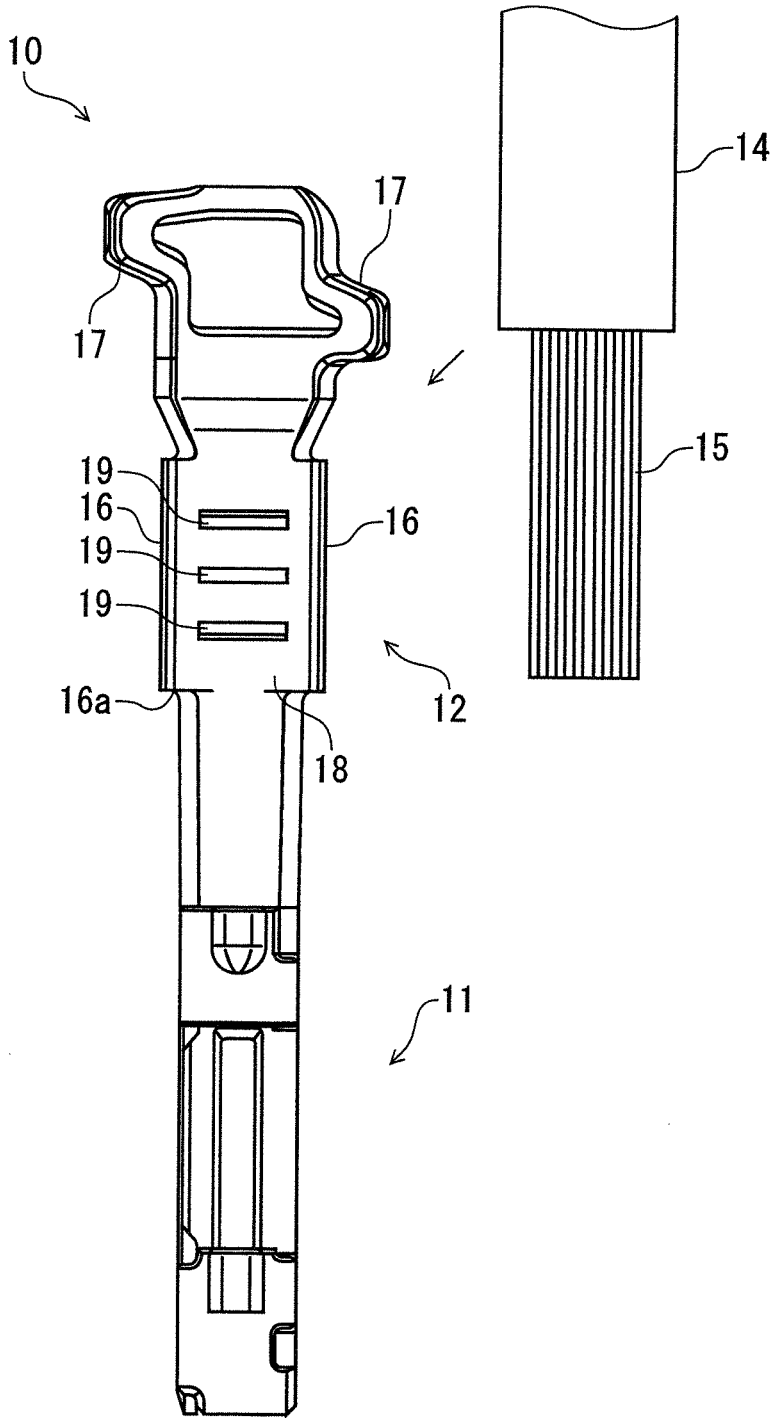
FIG. 1 is a plan view showing a terminal fitting according to an embodiment of the present invention being in a state before the terminal fitting is crimped.
Figure 2:
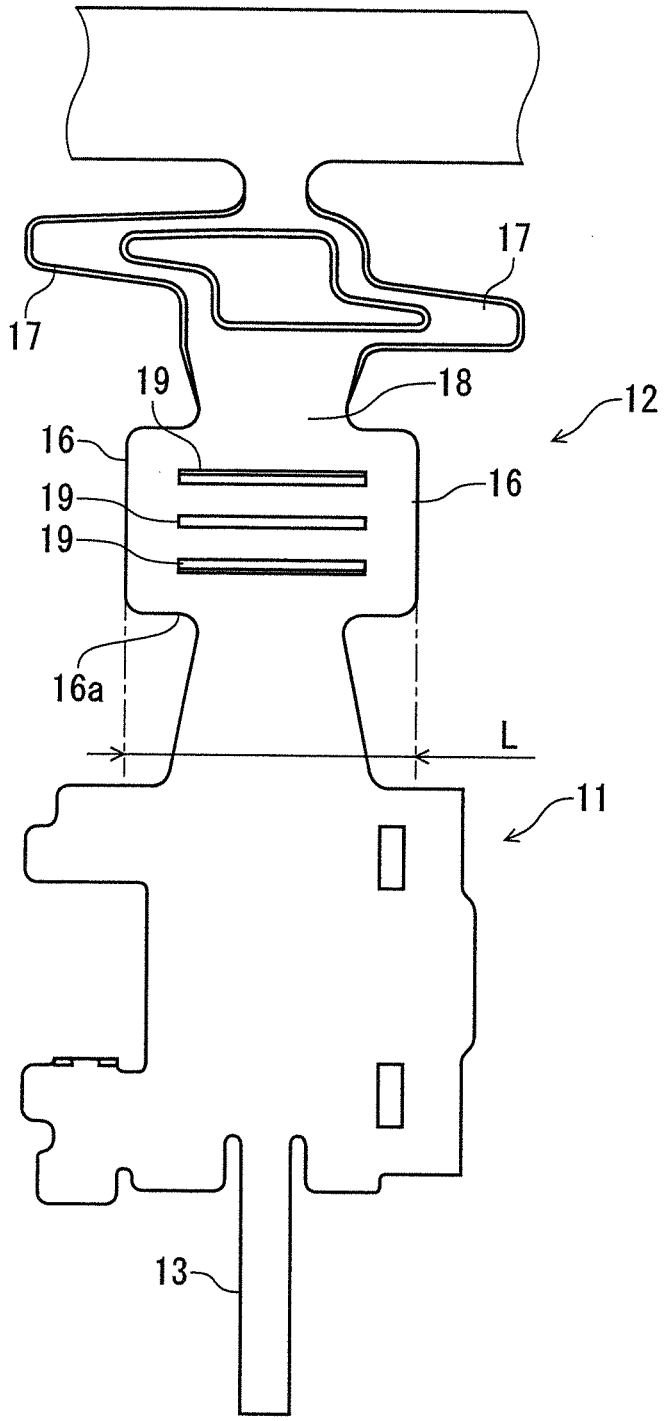
FIG. 2 is a plan view showing the terminal fitting being in a developed state.

As shown in FIG. 1, a terminal connection section 11 having a square cylindrical shape is formed on the tip end side (the lower side in the figure) of the terminal fitting 10, and an electric wire crimping section 12 is formed on the opposite side. An elastic contact piece 13 (see FIG. 2) formed into a nearly U-shape so as to be folded back from the tip end side is provided inside the terminal connection section 11. A tab terminal serving as a mating terminal is inserted into the terminal connection section 11 and makes contact with the elastic contact piece 13.

The electric wire 14 that is crimp-connected to the electric wire crimping section 12 has a core wire 15 made of aluminum or aluminum alloy. The electric wire crimping section 12 has a pair of wire barrel pieces 16 for crimping the core wire 15 of the electric wire 14 and a pair of insulation barrel pieces 17 for crimping the electric wire 14 at the covered portion thereof. The wire barrel pieces 16 are formed so as to rise from both end fringes of a bottom plate 18 having a semi-cylindrical shape in a state of being opposed to each other. Similarly, the insulation barrel pieces 17 are formed so as to rise from both end fringes of the bottom plate 18 in a state of being opposed to each other. The wire barrel pieces 16 are positioned closer to the tip end side than the insulation barrel pieces 17. In the bottom plate 18, serrations 19, three in number for example, extending in a direction orthogonal to the axial direction of the electric wire 14 are formed in a recessed shape at positions adjacent to the wire barrel pieces 16.

Figure 6:
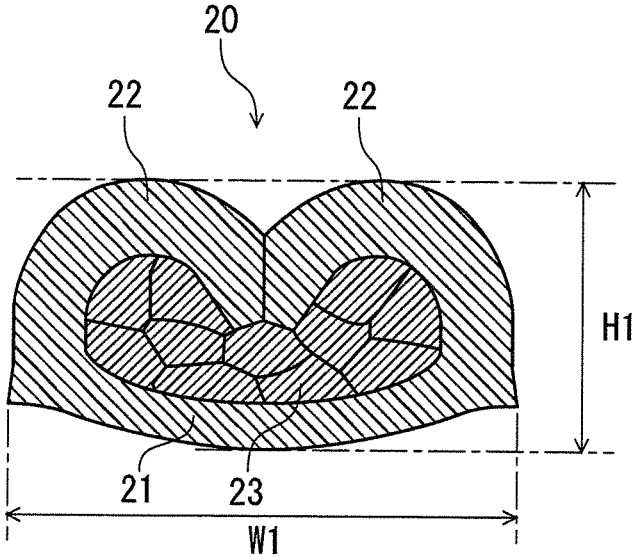
FIG. 6 is a view showing a crimped cross-section of an ideally crimped shape.
Figure 7:
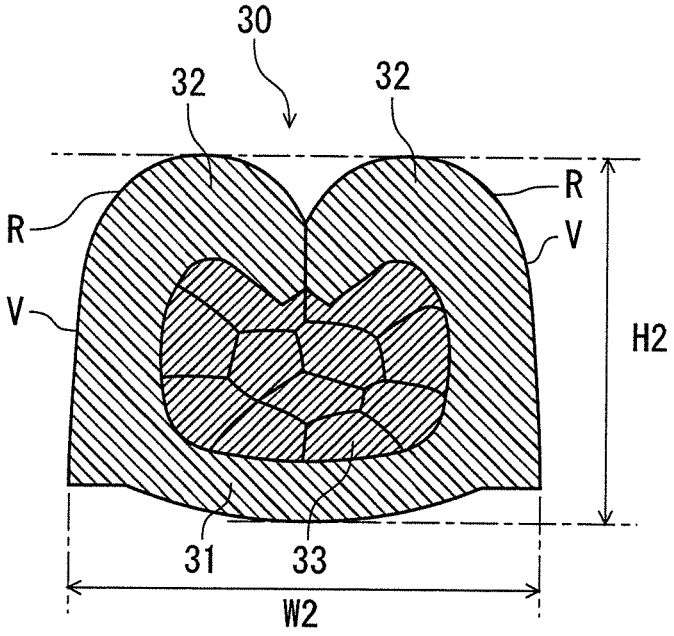
FIG. 7 is a view showing a crimped cross-section in the case that the height to width ratio of the electric wire crimping section is set larger than that shown in FIG. 6.
Figure 8:
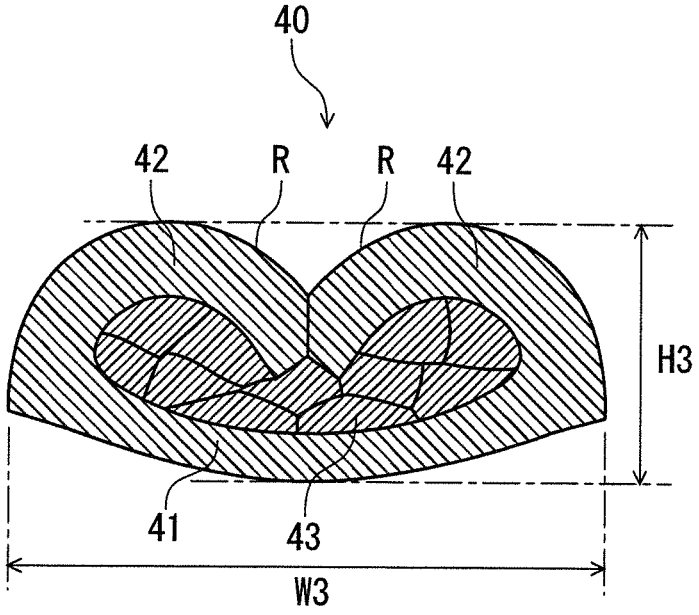
FIG. 8 is a view showing a crimped cross-section in the case that the height to width ratio of the electric wire crimping section is set smaller than that shown in FIG. 6.

FIG. 6 is a view showing the cross-sectional shape of the electric wire crimping section 12 having been crimped. In the crimped cross-section thereof, the tip end of one of the wire barrel pieces 16 is bent to the other wire barrel piece 16 and turned toward the bottom plate 18 of the electric wire crimping section 12. Furthermore, the element wires constituting the core wire 15 are swaged and deformed by crimping and made close contact with one another in a state in which there is almost no clearance. The core wire 15 is embedded inside the serrations 19. Even in the case that a non-conductive film is formed on the surface of the core wire 15, since the film is scraped away with the opening fringes of the serrations 19, the contact resistance at the connection section can be suppressed from increasing even if the terminal fitting 10 is subjected to a thermal shock cycle.

Figure 3:
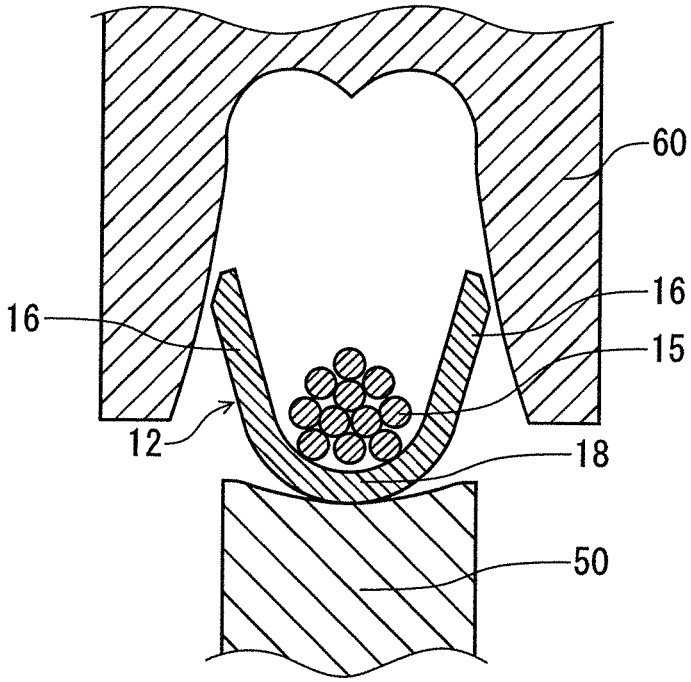
FIG. 3 is a sectional view showing a state in which the electric wire crimping section of the terminal fitting is placed on an anvil.

Next, a method for crimping the terminal fitting 10 will be described below referring to FIGS. 3 to 5. First, when the terminal fitting 10 to be crimped is set on a crimping machine (not shown), the bottom plate 18 of the terminal fitting 10 is placed on the upper face of an anvil 50, and the core wire 15 is placed on the bottom plate 18 as shown in FIG. 3. A crimper 60 is provided above the anvil 50. The electric wire crimping section 12 is crimped by lowering the crimper 60 toward the anvil 50.

Figure 4:
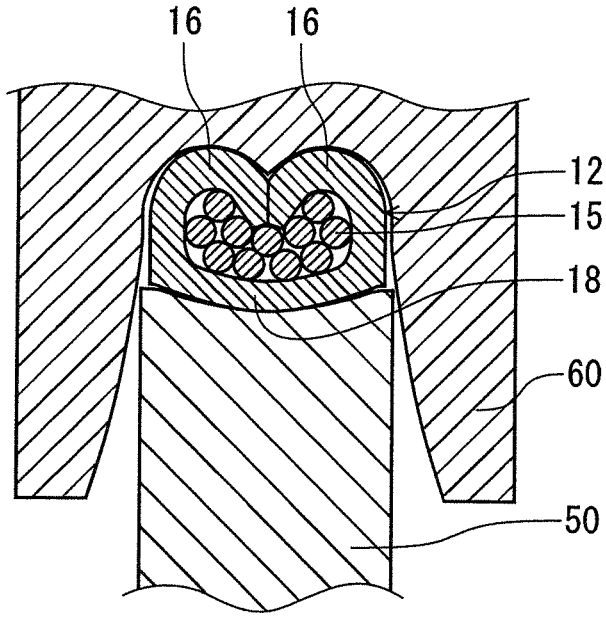
FIG. 4 is a sectional view showing a state in which a core wire and the electric wire crimping section are in the middle of being crimped using the anvil and a crimper.
Figure 5:
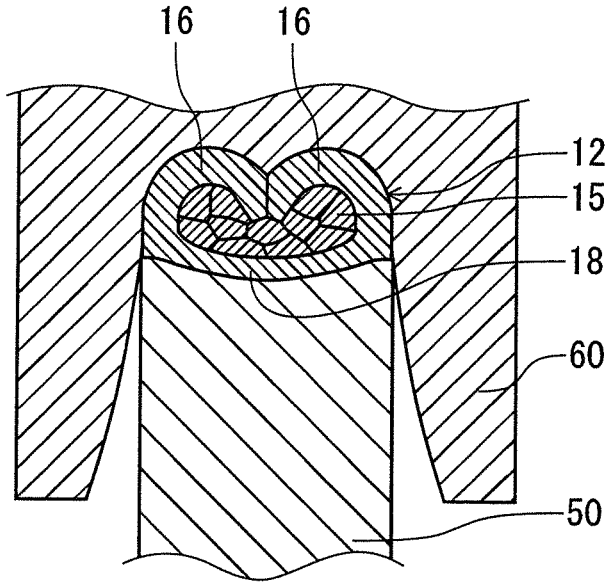
FIG. 5 is a sectional view showing a state in which the core wire and the electric wire crimping section have been crimped using the anvil and the crimper.

In the middle of the crimping, as shown in FIG. 4, the tip ends of both the wire barrel pieces 16 are bent so as to become close to each other along the crimping faces of the crimper 60, whereby the tip ends of both the wire barrel pieces 16 are made contact with each other. In this state, the element wires constituting the core wire 15 each maintain a circular cross-sectional shape, and clearances are formed among the element wires. When the crimper 60 is lowered further from the state shown in FIG. 4, the element wires constituting the core wire 15 are deformed and made close contact with one another in a state in which there is no clearance as shown in FIG. 5. Then, when the crimper 60 is raised and the terminal fitting 10 having been crimped is taken out, the terminal fitting 10 having the crimped shape shown in FIG. 6 is obtained.

Figure 9:
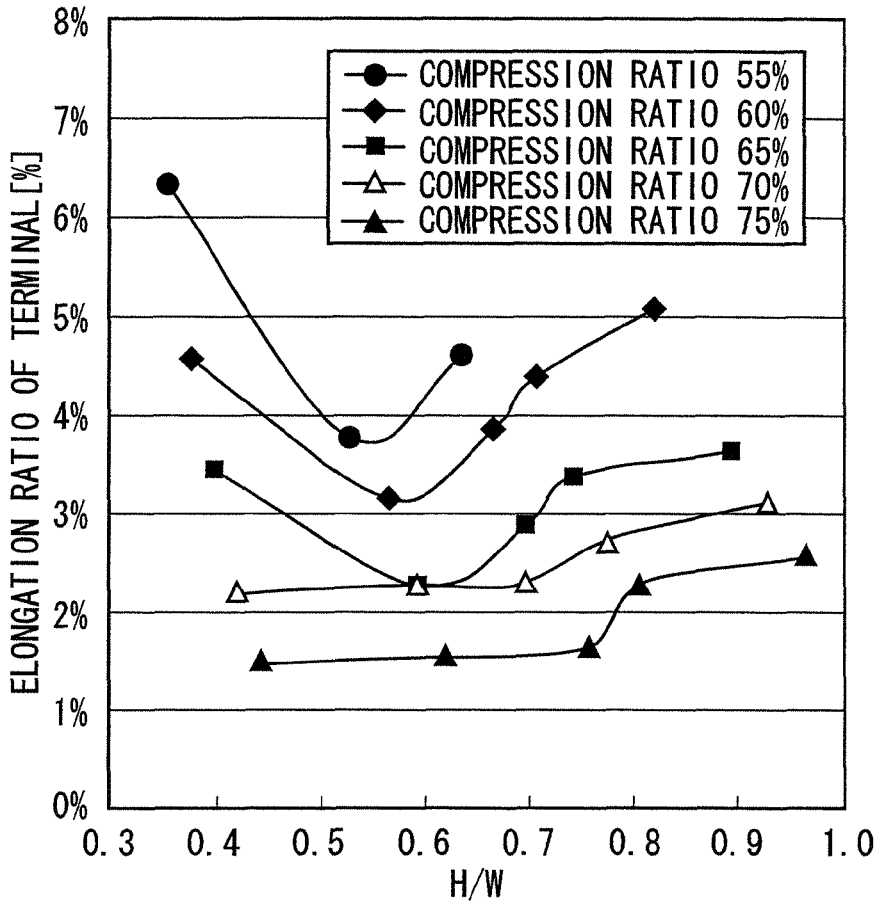
FIG. 9 is a graph representing the relationship between the height to width ratio and the elongation ratio of the terminal.

The embodiment will be described below in more detail by taking examples. FIG. 9 is a graph representing the relationship between the height to width ratio of the electric wire crimping section 12 and the elongation ratio of the terminal fitting 10. TABLES 1 to 3 shown below provide data on which the graph of FIG. 9 is based.

TABLE 1

| | Compression ratio 50% | | | | | | | Compression ratio 55% | | |
|---|---|---|---|---|---|---|---|---|---|---|
| C/H | | | | | | | | 1.05 | 1.00 | 0.80 |
| Compression ratio (%) | | | | | | | | 56.0 | 56.0 | 55.0 |
| C/W | 1.40 | 1.55 | 1.65 | 1.85 | 2.25 | 1.40 | 1.55 | 1.65 | 1.85 | 2.25 |
| H/W | | | | | | | | 0.64 | 0.53 | 0.36 |
| MIN. | | | | | | | | 0.046 | 0.037 | 0.062 |
| MAX. | | | | | | | | 0.046 | 0.038 | 0.065 |
| AVE. | | | | | | | | 0.046 | 0.038 | 0.064 |
| MAX-AVE | | | | | | | | 0.000 | 0.000 | 0.002 |
| AVE-MIN | | | | | | | | 0.000 | 0.000 | 0.002 |

TABLE 2

| | Compression ratio 60% | | | | | Compression ratio 65% | | | | |
|---|---|---|---|---|---|---|---|---|---|---|
| C/H | 1.15 | 1.10 | 1.10 | 1.05 | 0.85 | 1.25 | 1.15 | 1.15 | 1.10 | 0.90 |
| Compression ratio (%) | 58.0 | 60.3 | 61.5 | 63.0 | 60.3 | 66.7 | 66.0 | 67.0 | 69.3 | 65.7 |
| C/W | 1.40 | 1.55 | 1.65 | 1.85 | 2.25 | 1.40 | 1.55 | 1.65 | 1.85 | 2.25 |
| H/W | 0.82 | 0.71 | 0.67 | 0.57 | 0.38 | 0.89 | 0.74 | 0.70 | 0.59 | 0.40 |
| MIN. | 0.050 | 0.044 | 0.038 | 0.031 | 0.045 | 0.036 | 0.033 | 0.028 | 0.022 | 0.033 |
| MAX. | 0.052 | 0.044 | 0.039 | 0.032 | 0.047 | 0.036 | 0.034 | 0.029 | 0.023 | 0.036 |
| AVE. | 0.051 | 0.044 | 0.039 | 0.031 | 0.046 | 0.036 | 0.034 | 0.028 | 0.023 | 0.034 |
| MAX-AVE | 0.001 | 0.000 | 0.000 | 0.001 | 0.001 | 0.000 | 0.001 | 0.001 | 0.001 | 0.001 |
| AVE-MIN | 0.001 | 0.000 | 0.000 | 0.000 | 0.001 | 0.000 | 0.000 | 0.000 | 0.001 | 0.001 |

TABLE 3

| | Compression ratio 70% | | | | | Compression ratio 75% | | | | |
|---|---|---|---|---|---|---|---|---|---|---|
| C/H | 1.30 | 1.20 | 1.20 | 1.10 | 0.95 | 1.35 | 1.25 | 1.25 | 1.15 | 1.00 |
| Compression ratio (%) | 71.0 | 71.7 | 67.0 | 69.3 | 71.0 | 75.3 | 77.3 | 78.0 | 75.7 | 76.3 |
| C/W | 1.40 | 1.55 | 1.65 | 1.85 | 2.25 | 1.40 | 1.55 | 1.65 | 1.85 | 2.25 |
| H/W | 0.93 | 0.77 | 0.70 | 0.59 | 0.42 | 0.96 | 0.81 | 0.76 | 0.62 | 0.44 |
| MIN. | 0.030 | 0.027 | 0.022 | 0.022 | 0.021 | 0.024 | 0.022 | 0.016 | 0.015 | 0.014 |
| MAX. | 0.031 | 0.027 | 0.023 | 0.023 | 0.023 | 0.026 | 0.023 | 0.017 | 0.016 | 0.015 |
| AVE. | 0.031 | 0.027 | 0.023 | 0.023 | 0.022 | 0.025 | 0.023 | 0.016 | 0.015 | 0.015 |
| MAX-AVE | 0.000 | 0.000 | 0.001 | 0.001 | 0.001 | 0.001 | 0.000 | 0.000 | 0.001 | 0.001 |
| AVE-MIN | 0.000 | 0.000 | 0.001 | 0.001 | 0.001 | 0.001 | 0.001 | 0.000 | 0.000 | 0.001 |

Each piece of data in the graph is a piece of data representing the average value of the elongation ratios (N=10). The values shown in the AVE. column of each table are plotted in the graph. The other experiment conditions are as described in the area enclosed by the rectangle shown in the lower portion of FIG. 9. The developed length of the barrel in the experiment conditions shown in FIG. 9 is the dimension designated by L in FIG. 2.

In the case of a compression ratio of 55%, when H/W=0.53, the elongation ratio becomes minimal (3.8%). When the H/W is smaller (H/W=0.36), the elongation ratio is larger. On the other hand, when the H/W is larger (H/W=0.64), the elongation ratio is also larger. Similarly, in the case of a compression ratio of 60%, when H/W=0.57, the elongation ratio becomes minimal. In the case of a compression ratio of 65%, when H/W=0.59, the elongation ratio becomes minimal.

The lowest point in which the elongation ratio becomes minimal, found in the cases of compression ratios of 55% to 65%, is not found in the cases of compression ratios of 70% and 75%, and the portions having small elongation ratios have a flat shape. However, although the elongation ratios in the cases of compression ratios of 70% and 75% are smaller than those in the cases of compression ratios of 55% to 65%, since the contact resistance is likely to increase when the terminal fitting 10 is subjected to the thermal shock cycle, it is preferable that the compression ratio should be 55% or more and 65% or less.

As described above, in the case that the height to width ratio is set to 0.5 or more and 0.6 or less and that the compression ratio is set to 55% or more and 65% or less, the embodiment produces an excellent effect capable of preventing the contact resistance from increasing even if the terminal fitting is subjected to the thermal shock cycle while the elongation ratio of the terminal fitting is suppressed small. In particular, in the case that the height to width ratio is set to 0.55 and that the compression ratio is set to 60%, an ideally crimped cross-sectional shape can be obtained.

The present invention is not limited to the embodiment described above and illustrated in the drawings, but includes, for example, the following embodiments within the technical scope of the present invention.

(1) Although the present invention is applied to the female terminal fitting 10 in the above-mentioned embodiment, the present invention may also be applied to a male terminal fitting (a tab terminal).

(2) Although the electric wire crimping section 12 is crimp-connected to the core wire 15 exposed at the end of the electric wire 14 in the above-mentioned embodiment, it may be possible that the covering in the middle of the electric wire 14 is removed to partly expose the core wire 15 and the electric wire crimping section 12 is crimp-connected to the exposed core wire 15 according to the present invention.

What is claimed is:

1. A crimped electric wire with a terminal, comprising:

an electric wire having a core wire made of aluminum or aluminum alloy; and a terminal fitting made of a copper alloy and having an electric wire crimping section for crimping the core wire partly exposed from the electric wire;

a value obtained by dividing a height of the electric wire crimping section measured parallel to a crimping direction by a width of the electric wire crimping section measured transverse to the height after the crimping of the electric wire crimping section defining a height to width ratio in a range of 0.5 to 0.6;

a value obtained by dividing a gross cross-sectional area of the core wire after the crimping of the electric wire crimping section by a gross cross-sectional area of the core wire before the crimping of the electric wire crimping section defining a compression ratio in a range of 55% to 65%; and a total length of the terminal fitting after crimping is less than 4% longer than a length of the terminal fitting before crimping.

2. The crimped electric wire with the terminal according to claim 1, wherein:

the height to width ratio is set to 0.55; and the compression ratio is set to 60%.

3. The crimped electric wire with the terminal according to claim 1, wherein:

the electric wire crimping section is equipped with a pair of barrel pieces rising from both end fringes of the bottom plate of the terminal fitting; and the tip end of one of the barrel pieces is bent to the other barrel piece and turned toward the bottom plate.

* * * * *